US011779086B2

(12) United States Patent
Sharp et al.

(10) Patent No.: US 11,779,086 B2
(45) Date of Patent: Oct. 10, 2023

(54) FLAME AND HEAT-RESISTANT FASTENER CHAIN AND METHODS OF MANUFACTURING THE SAME

(71) Applicant: YKK Corporation, Tokyo (JP)

(72) Inventors: Justin Sharp, Warner Robins, GA (US); Robert Womick, Warner Robins, GA (US); Cyrus Jones, Byron, GA (US); Jerry Baldwin, Byron, GA (US); Tommy Minter, Byron, GA (US)

(73) Assignee: YKK Corporation, Tokyo (JP)

( * ) Notice: Subject to any disclaimer, the term of this patent is extended or adjusted under 35 U.S.C. 154(b) by 204 days.

(21) Appl. No.: 17/223,839

(22) Filed: Apr. 6, 2021

(65) Prior Publication Data

US 2022/0312906 A1 Oct. 6, 2022

(51) Int. Cl.

| | |
|---|---|
| ***A44B 19/34*** | (2006.01) |
| ***D03D 15/513*** | (2021.01) |
| ***A44B 19/12*** | (2006.01) |

(52) U.S. Cl.

CPC ..... *A44B 19/34* (2013.01); *A44B 19/12* (2013.01); *D03D 15/513* (2021.01)

(58) Field of Classification Search

CPC ..... A44B 19/00; A44B 19/24; A44B 19/12; A44B 19/34

See application file for complete search history.

(56) References Cited

U.S. PATENT DOCUMENTS

| | | | | |
|---|---|---|---|---|
| 5,176,944 | A | 1/1993 | Striegl et al. | |
| 9,521,884 | B2 | 12/2016 | Matsuzawa et al. | |
| 2005/0235466 | A1* | 10/2005 | Segawa | A44B 19/34 24/396 |
| 2006/0008664 | A1 | 1/2006 | Wakabayashi et al. | |

(Continued)

FOREIGN PATENT DOCUMENTS

| | | | |
|---|---|---|---|
| CN | 102845933 | A | 1/2013 |
| CN | 102845934 | A | 1/2013 |

(Continued)

OTHER PUBLICATIONS

Machine English Translation of JP 2006305031 as produced by https://www.j-platpat.inpit.go.jp/ (Year: 2023).*

(Continued)

*Primary Examiner* — Robert Sandy
*Assistant Examiner* — Michael S Lee
(74) *Attorney, Agent, or Firm* — Meunier Carlin & Curfman LLC

(57) ABSTRACT

According to various implementations, a flame-resistant and heat-resistant fastener chain includes a pair of left and right fastener tapes and a pair of left and right continuous fastener elements. Each fastener tape includes a facing tape side edge that faces the facing tape side edge of the other fastener tape. The left continuous fastener element is coupled to the left fastener tape adjacent the facing tape side edge of the left fastener tape and the right continuous fastener element is coupled to the right fastener tape adjacent the facing tape side edge of the right fastener tape. Each continuous fastener (Continued)

element includes a coiled monofilament that includes a high temperature polymer. In some implementations, the continuous fastener element includes a cord around which the coiled monofilament is wrapped.

18 Claims, 6 Drawing Sheets

(56) References Cited

U.S. PATENT DOCUMENTS

| | | | | |
|---|---|---|---|---|
| 2013/0185903 | A1 | 7/2013 | Matsuzawa et al. | |
| 2015/0366300 | A1 | 12/2015 | Sho et al. | |
| 2018/0140026 | A1* | 5/2018 | Nijmeh | A41D 15/04 |
| 2019/0166959 | A1* | 6/2019 | Takani | A44B 19/346 |

FOREIGN PATENT DOCUMENTS

| | | | |
|---|---|---|---|
| CN | 202774514 | U | 3/2013 |
| CN | 202774515 | U | 3/2013 |
| CN | 105050447 | A | 11/2015 |
| CN | 111020816 | A | 4/2020 |
| JP | 52136051 | A | 11/1977 |
| JP | 2006305031 | A | 11/2006 |
| JP | 5414905 | B2 | 2/2014 |
| WO | 2003066956 | A1 | 8/2003 |

OTHER PUBLICATIONS

Article from NCBI.nlm.nih.gov for "Computational Characterization of Nylon 4, a Biobased and Biodegradable Polyamide Superior to Nylon 6" by Yuchio Fukuda and Yuji Sasanuma Aug. 20, 2018 (Year: 2018).*

International Search Report and Written Opinion, dated Jun. 14, 2022, received in connection with corresponding International Patent Application No. PCT/JP2022/013758.

"Standard on Flame-Resistant Clothing for Protection of Industrial Personnel Against Short-Duration Thermal Exposures from Fire," National Fire Protection Association (NFPA) Standard 2112, 2018 edition.

Office Action, including English translation, issued for Taiwanese Application No. 111112746, dated Oct. 19, 2022, 27 pages.

* cited by examiner

FLAME AND HEAT-RESISTANT FASTENER CHAIN AND METHODS OF MANUFACTURING THE SAME

BACKGROUND

Flash fires are sudden, intense fires that spread by means of a flame front moving rapidly through a diffuse fuel, such as dust, flammable gas, or the vapors of an ignitable liquid. Flash fires are characterized by a high temperature, short duration, and rapidly moving flame front. Workers in certain hazardous industrial occupations are at risk of exposures to flash fires and require special flame-resistant clothing during the course of their work. Guidelines for specialized flash fire resistant garments are provided in "Standard on Flame Resistant Garments for Protection of Industrial Personnel Against Flash Fire" by the National Fire Protection Association (NFPA) in NFPA 2112, 2018 edition. All flash fire clothing complying with NFPA 2112 must achieve a 50% or less predicted body burn and must defy melting, dripping, or after-flame burning, along with other criteria established through various requirements and tests provided in the guidelines.

Standard textile fasteners (typically formed from polyesters and polyamides) have little flame resistance. While these components typically comprise only a small proportion of the total weight of the garment, their low flame resistance can have a critical bearing on the overall flammability rating of the garment. While the application or incorporation of flame-retardant chemicals into fasteners has been previously described, these fasteners would still exhibit vulnerability to high temperatures (leading to melting, dripping, separation, or ignition) that would fail to meet the guidelines set forth in NFPA 2112. Therefore, there is a clear need for the development of fasteners, such as fastener chains, that are inherently heat- and flame-resistant for use in flame-resistant clothing for flash fires.

BRIEF SUMMARY

According to a first aspect, a flame-resistant and heat resistant fastener chain comprises a pair of left and right fastener tapes and a pair of left and right continuous fastener elements. Each fastener tape includes a facing tape side edge that faces the facing tape side edge of the other fastener tape. The pair of left and right continuous fastener elements are coupled to the respective left and right fastener tapes adjacent the facing tape side edges, and each continuous fastener element comprises a coiled monofilament. The coiled monofilaments comprise a high temperature polymer having a melting point from 260 degrees Celsius to 400 degrees Celsius.

In some implementations, the high temperature polymer comprises polyethyleneimine (PEI), a liquid crystal polymer (LCP), polyphthalamide (PPA), polyphenylene sulfide (PPS), polyamide 46 (PA46), polytetrafluoroethylene (PTFE), fluorinated ethylene propylene (FEP), a perfluoroalkoxyalkane (PFA), polycylohexylenedimethylene terephthalate (PCT), polyxylylene adipamide (PAMXD6), polybutylene succinate (PBS), or combinations thereof.

In some implementations, the high temperature polymer is polyphenylene sulfide (PPS).

In some implementations, the high temperature polymer has a limiting oxygen index (LOI) of greater than 20%.

In some implementations, the high temperature polymer has a color that is different than a natural color for the polymer.

In some implementations, each fastener tape comprises flame-resistant and heat-resistant fibers.

In some implementations, each fastener tape comprises aramid fibers.

In some implementations, each fastener tape comprises meta-aramid fibers.

In some implementations, each continuous fastener element comprises a cord around which the respective coiled monofilament is wrapped.

In some implementations, each cord comprises flame-resistant and heat-resistant fibers.

In some implementations, each cord comprises aramid fibers.

In some implementations, each cord comprises meta-aramid fibers.

In some implementations, the fastener chain comprises at least one left thread and at least one right thread. The at least one left thread couples the left continuous fastener element to the left fastener tape, and the at least one right thread couples the right continuous fastener to the right fastener tape.

In some implementations, each thread comprises flame-resistant and heat-resistant fibers.

In some implementations, each thread comprises aramid fibers.

In some implementations, each thread comprises para-aramid fibers.

In some implementations, the fasteners tapes are woven fastener tapes.

The implementations of the fastener chain according to the first aspect described above and herein may be included with the fastener chain individually or in combination with one or more other implementations described above or otherwise herein.

According to a second aspect, a slide fastener includes the fastener chain according to the first aspect. The slide fastener according to the second aspect may include one or more of the implementations of the fastener chain according to the first aspect noted above or otherwise described herein.

According to a third aspect, a method for manufacturing a continuous fastener element for a flame-resistant and heat-resistant fastener chain includes coiling a monofilament at a temperature from 100 degrees Celsius to 200 degrees Celsius to form a coiled monofilament, wherein the monofilament comprises a high temperature polymer having a melting point from 260 degrees Celsius to 400 degrees Celsius, and coupling the coiled monofilament to a fastener tape. In some implementations, the method according to the third aspect further includes wrapping the coiled monofilament around a cord.

The fastener chain according to the first aspect may or may not be obtained using the methods of the third aspect or implementations thereof described herein.

BRIEF DESCRIPTION OF THE DRAWINGS

Example features and embodiments are disclosed in the accompanying drawings.

However, the present disclosure is not limited to the precise arrangement shown, and the drawings are not necessarily drawn to scale.

DETAILED DESCRIPTION

Figure 1:
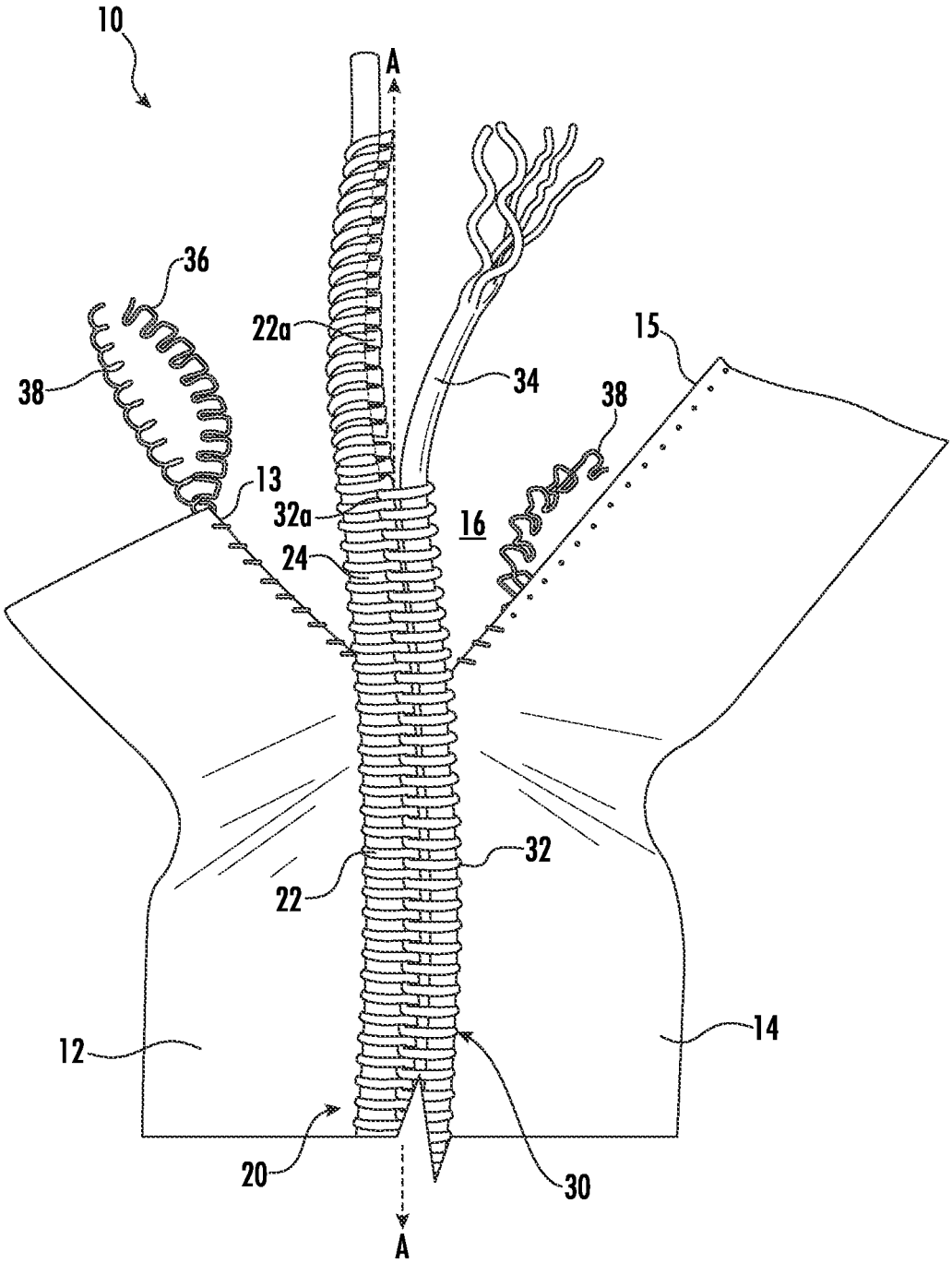
FIG. 1 is a rear view of a flame and heat-resistant fastener chain according to one implementation.

According to various implementations, a flame-resistant and heat-resistant fastener chain includes a pair of left and right fastener tapes and a pair of left and right continuous fastener elements. Each fastener tape includes a facing tape side edge that faces the facing tape side edge of the other fastener tape. The left continuous fastener element is coupled to the left fastener tape adjacent the facing tape side edge of the left fastener tape, and the right continuous fastener element is coupled to the right fastener tape adjacent the facing tape side edge of the right fastener tape. Each continuous fastener element includes a coiled monofilament that includes a high temperature polymer. In some implementations, the continuous fastener element includes a cord around which the coiled monofilament is wrapped. And, in some implementations, each continuous fastener element is coupled to the respective fastener tape by one or more threads.

Various implementations of the flame-resistant and heat-resistant fastener chain and slide fastener described herein are more flexible, lighter weight, and less expensive to manufacture than slide fasteners that are made with individual molded teeth and metal teeth. In addition, the implementations described herein have a higher puncture strength than slide fasteners made with individual molded teeth and metal teeth, and the implementations described herein have a higher crosswise strength than slide fasteners made with individual molded teeth.

The implementations of the flame-resistant and heat-resistant fastener chain and slide fastener described herein comply with the standards set forth for hardware components intended for inclusion in flame-resistant garments and as described in NFPA 2112. According to NFPA 2112 guidelines, hardware used in the construction of flame-resistant garments, such as fasteners, must demonstrate heat resistance by not melting and dripping, separating, or igniting, and shall remain functional after exposure to a temperature of 260° C. for five minutes. Further, any fabric components must separately show flame resistance by not having a char length of greater than 4.0 inches or an average after-flame time greater than two seconds and must not show any melting with dripping when tested according to ASTM D6413/D6413M-15 titled "Standard Test Method for Flame Resistance of Textiles (Vertical Test)", as described for flame-resistance testing in NFPA 2112. Smaller fabric, fibers, or textile components (such as the cord thread and/or film portions of the fastener chain described herein) may be tested similarly according to ASTM D6413/D6413M-15 but do not require adherence to the char length guidelines provided above. According to certain implementations, the implementations of the flame-resistant and heat-resistant fastener chain and slide fastener described herein meet the standard required by the heat resistance test provided in NFPA 2112, i.e., the fastener chain does not melt, drip, separate, or ignite and remains fully functional after exposure to a temperature of 260° C. for five minutes.

FIG. 1 illustrates a flame-resistant and heat-resistant fastener chain according to one implementation. The fastener chain 10 includes a left fastener tape 12, a right fastener tape 14, a left continuous fastener element 20, a right continuous fastener element 30, and threads 36, 38. Each fastener tape 12, 14 includes a respective facing tape side edge 13, 15, and the side edges 13, 15 face each other across a lateral gap 16. To couple the continuous fastener elements 20, 30 to the fastener tapes 12, 14, the left continuous fastener element 20 is sewn to a portion of the fastener tape 12 adjacent the facing tape side edge 13 with threads 36, 38, and the right continuous fastener element 30 is sewn to a portion of the fastener tape 14 adjacent the facing tape side edge 15 with threads 36, 38.

The fastener tapes 12, 14 are woven with flame-resistant and heat-resistant fibers. Representative examples of suitable fibers for use in the fastener tapes described herein include, but are not limited to, aramid fibers (such as meta-aramid or para-aramid), PTFE fibers, PPS fibers, polybenzimidazole (PBI) fibers, fibers formed from a liquid crystal polymer (e.g., VECTRAN™ fibers), fire-resistant cotton, fiberglass, or combinations thereof. In one implementation, the fibers may include aramid fibers. For example, the fastener tapes 12, 14 are woven with 33/2 aramid yarns. The fastener tapes 12, 14 may be dyable after weaving or can be solution dyed. In addition, the woven fastener tapes 12, 14 may be woven using known tape patterns and machinery. Further, the fastener tapes meet the standard for flame-resistance provided in NFPA 2112 as determined by ASTM D6413/D6413M-15. However, in other implementations, the fastener tapes include meta-aramid fibers, para-aramid fibers, or a combination of para-aramid and meta-aramid fibers, and other suitable yarn sizes may be selected (e.g., based on the material of the yarn) that are sufficiently strong to resist tearing when coupled to the coiled fastener element. In other implementations, the fastener tapes may be knit or made from another suitable process (e.g., non-woven) that provides a fastener tape that is sufficiently strong to resist tearing when coupled to the coiled fastener element using any or a combination of the flame and heat resistant fibers described herein.

Each continuous fastener element 20, 30 includes a respective coiled monofilament 22, 32 that includes a high temperature polymer and a respective cord 24, 34 around which the coiled monofilament 22, 32 is wrapped. Each coiled monofilament 22, 32 includes a plurality of coupling elements with coupling surfaces 22*a*, 32*a*, respectively. The coupling surfaces 22*a* of coiled monofilament 22 are configured to be removably engaged between axially adjacent coupling surfaces 32*a* of the coiled monofilament 32, and vice versa. In the embodiment shown in FIG. 1, the coupling surfaces 22*a*, 32*a* are formed (e.g., flattened) portions of the coiled monofilament 22, 32 that have a cross sectional shape that is different from the non-coupling surfaces 22*a*, 32*a*. The coupling surfaces 22*a*, 32*a* have an axial length (as measured in the direction of longitudinal axis A-A, also referred to as the head size) that is longer than an axial length of a gap defined between axially adjacent coupling surfaces 22*a*, 32*a*.

As used herein, a "high temperature polymer" is defined as a polymer having a melting point ranging from 260° C. to 400° C. Suitable high temperature polymers may be readily identified from known polymers having a melting point within the above range or by determining the melting point of a polymer of interest using known methods, for example differential scanning calorimetry.

In some implementations, the high temperature polymer may have a melting point ranging from 280° C. to 400° C., from 300° C. to 400° C., from 320° C. to 400° C., from 340°

C. to 400° C., from 360° C. to 400° C., from 380° C. to 400° C., from 260° C. to 380° C., from 280° C. to 380° C., from 300° C. to 380° C., from 320° C. to 380° C., from 340° C. to 380° C., from 360° C. to 380° C., from 260° C. to 360° C., from 280° C. to 360° C., from 300° C. to 360° C., from 320° C. to 360° C., from 340° C. to 360° C., from 260° C. to 340° C., from 280° C. to 340° C., from 300° C. to 340° C., from 320° C. to 340° C., from 260° C. to 320° C., from 280° C. to 320° C., from 300° C. to 320° C., from 260° C. to 300° C., from 280° C. to 300° C., or from 260° C. to 280° C.

In one such implementation, the high temperature polymer is polyphenylene sulfide (PPS). However, other implementations may include a high temperature polymer comprising polyetherimide (PEI), a liquid crystal polymer (LCP), polyphthalamide (PPA), polyamide 46 (PA46), polytetrafluoroethylene (PTFE), fluorinated ethylene propylene (FEP), a perfluoroalkoxyalkane (PFA), polycylohexylenedimethylene terephthalate (PCT), polyxylylene adipamide (PAMXD6), polybutylene succinate (PBS), or combinations thereof.

In addition, in any of the implementations described above, or in other implementations, the high temperature polymer selected for the coiled monofilament may have a limiting oxygen index (LOI) of greater than 20%, for example an LOI of 25%, of 30%, of 35%, of 40%, of 45%, of 50%, of 55%, of 60%, of 65%, of 70%, of 75%, of 80%, of 85%, of 90%, of 95% or more. The LOI for the high temperature polymer may be readily determined according to the protocol provided in ASTM D2863-19 titled "Standard Test Method for Measuring the Minimum Oxygen Concentration to Support Candle-Like Combustion of Plastics (Oxygen Index)".

The high temperature polymer may also have a color that is different than a natural color for the polymer. For example, the high temperature polymer may be solution-dyed with pigments during extrusion to be a color that is different than the natural color of the polymer before extrusion.

Coiled monofilaments can be characterized by a dimensionless size, typically from 3 to 10 (e.g., 5), according to some implementations. The size of the coiled monofilament is based on (e.g., is proportional to) the overall width in millimeters of the joined coupling elements, but the size number is not necessarily equal to the overall width.

The cords 24, 34 comprise flame-resistant and heat-resistant fibers. Representative examples of suitable fibers for use in the cords described herein include, but are not limited to, aramid fibers (such as meta-aramid or para-aramid fibers), PTFE fibers, PPS fibers, polybenzimidazole (PBI) fibers, fibers formed from a liquid crystal polymer (e.g., VECTRAN™ fibers), fire-resistant cotton, fiberglass, or combinations thereof. In one implementation, the fibers of the cords 24, 34 may include aramid fibers. For example, the cords 24, 34 may be made with 20/2 aramid yarn and made using known twist cord patterns related to the size of the coiled monofilament. In other implementations, the fibers of the cords 24, 34 include meta-aramid and/or other suitable flame-resistant fibers. Further, the cords meet the standard for flame-resistance provided in NFPA 2112 as determined by ASTM D6413/D6413M-15.

The cords 24, 34 shown in FIG. 1 are twisted, but in other implementations, a knit cord or other suitable cord can be used. In addition, the cord selected can have yarns of different sizes and/or numbers of twists per inch. The cord is selected to at least partially fill a radial cross-sectional area of a channel defined by an inner diameter of the coiled monofilament.

The threads 36, 38 also comprise flame-resistant and heat-resistant fibers. Representative examples of suitable fibers for use in the threads described herein include, but are not limited to, aramid fibers (such as meta-aramid or para-aramid fibers), PTFE fibers, PPS fibers, PBI fibers, fibers formed from a liquid crystal polymer (e.g., VECTRAN™ fibers), fire-resistant cotton, fiberglass, or combinations thereof. For example, in the implementation shown in FIG. 1, the fibers of the threads 36, 38 includes para-aramid fibers (e.g., CRAQ-SPUN®). However, in other implementations, the fibers of the threads include meta-aramid and/or other suitable flame-resistant and heat-resistant fibers.

The size (e.g., measured as tex) of the threads 36, 38 selected corresponds with the size of the coiled monofilament selected. For example, a larger size thread may be selected for a larger sized coiled monofilament. A lower TEX number represents a larger thread size (e.g., Tex 20>Tex 35>Tex 45). For example, a thread having a TEX of 35 works well with a size 5 coiled monofilament. However, any thread size that allows for coupling the coiled monofilament to the fastener tape is acceptable.

In addition, in the implementation shown in FIG. 1, the threads 36, 38 include a looper thread 36 and a needle thread 38 to couple the continuous fastener elements 20, 30 to the respective fastener tapes 12, 14. However, in other implementations, other suitable stitch patterns for coupling continuous fastener elements to fastener tapes may be used instead of looper and needle threads.

Figure 2A:
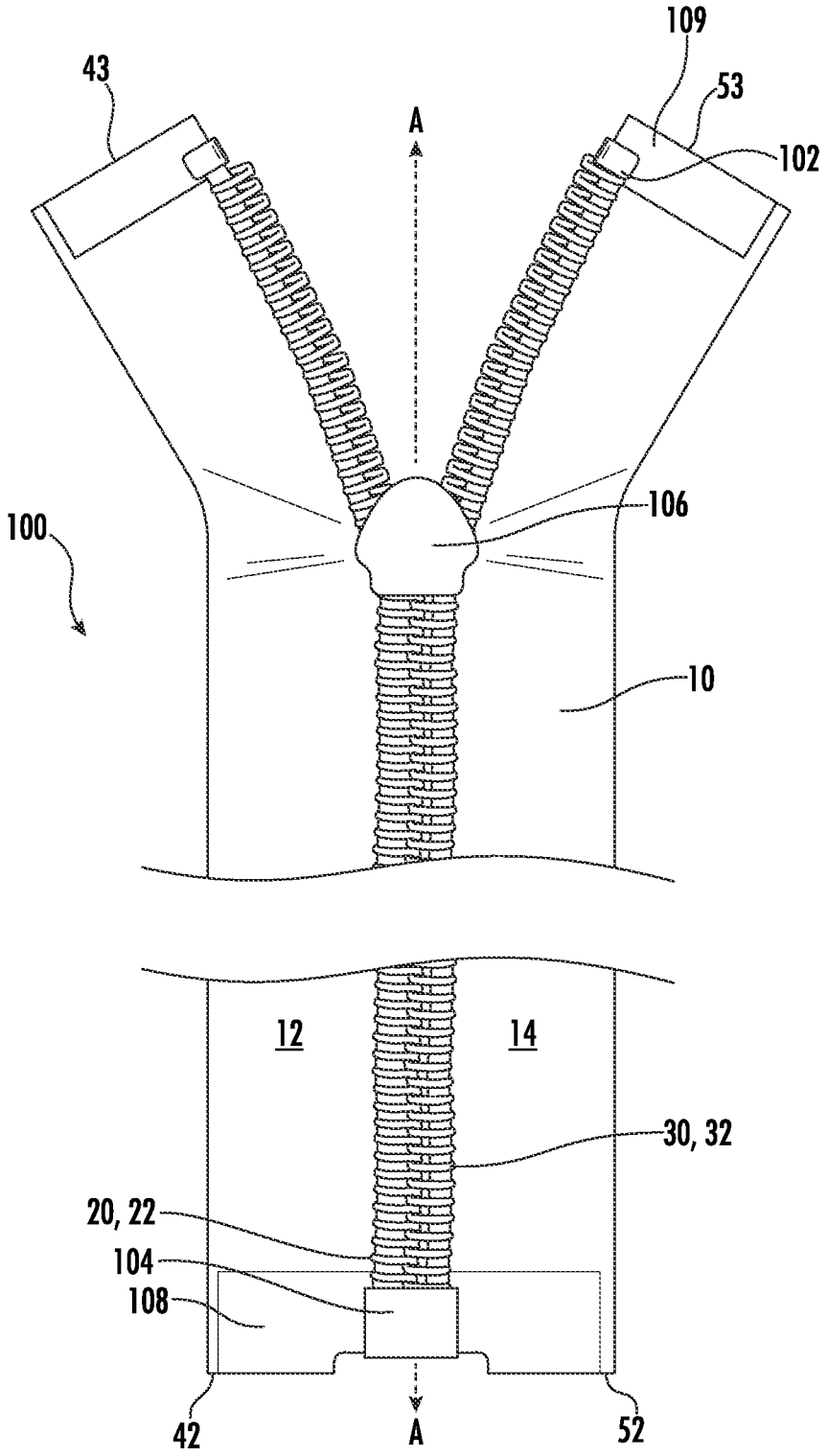
FIG. 2A is a rear view of a slide fastener according to one implementation comprising the fastener chain shown in FIG. 1.
Figure 2B:
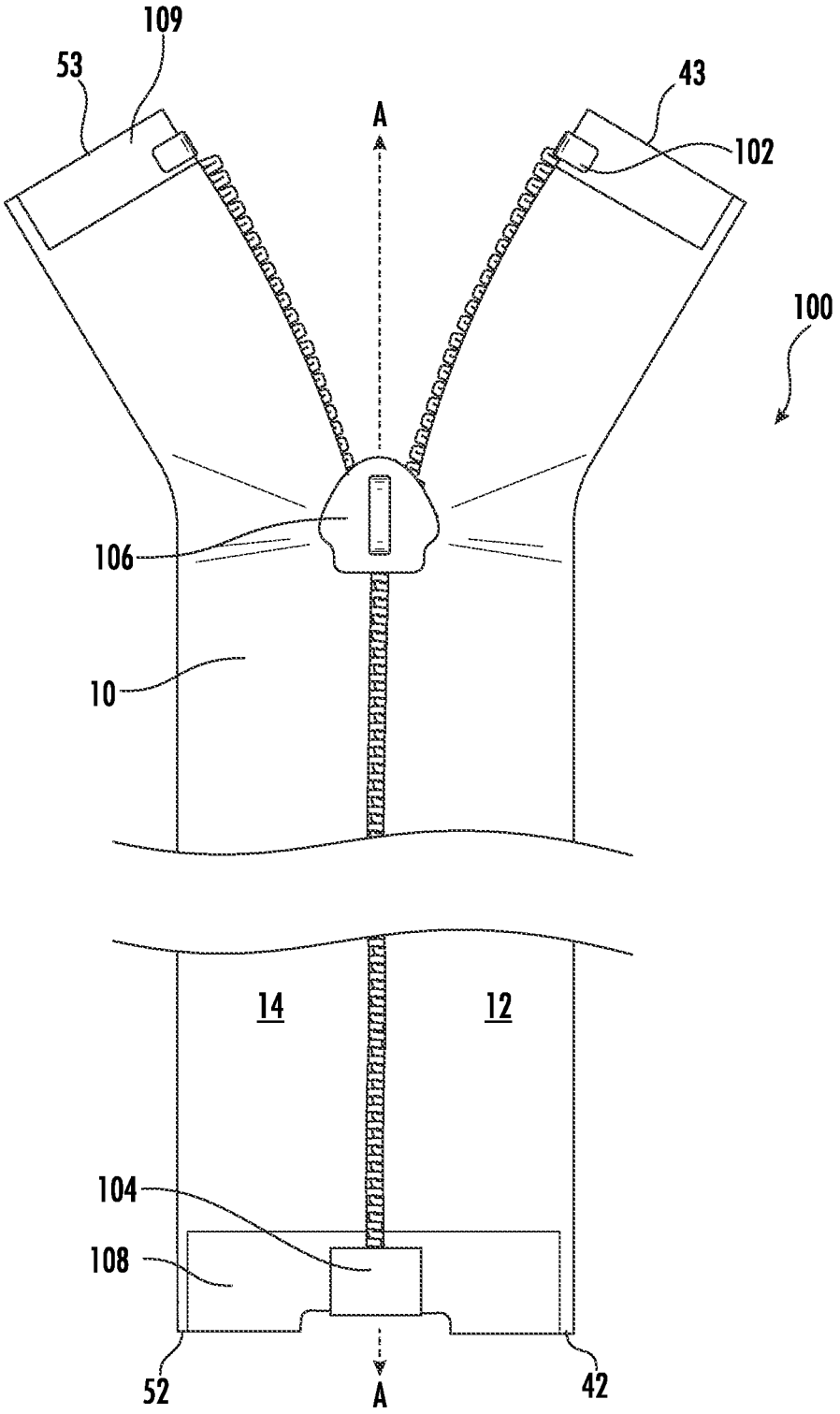
FIG. 2B is a front view of the slide fastener in FIG. 2A.

FIGS. 2A and 2B illustrate a slide fastener 100 comprising the fastener chain 10 shown in FIG. 1, according to one implementation. The slide fastener 100 further includes a top stop 102, a bottom stop 104, and a slider 106. The slider 106 is pulled over the continuous fastener elements 20, 30 in a first direction (away from the bottom stop 104) along the longitudinal axis A-A of the slide fastener 100 to cause the coupling surfaces 22*a*, 32*a* of the continuous fastener elements 20, 30 to engage with each other, and the slider 106 is pulled over the continuous fastener elements 20, 30 in a second direction (toward the bottom stop 104) along the longitudinal axis A-A to cause the coupling surfaces 22*a*, 32*a* to disengage with each other. The first and second directions are axially opposite each other.

Figure 4A:
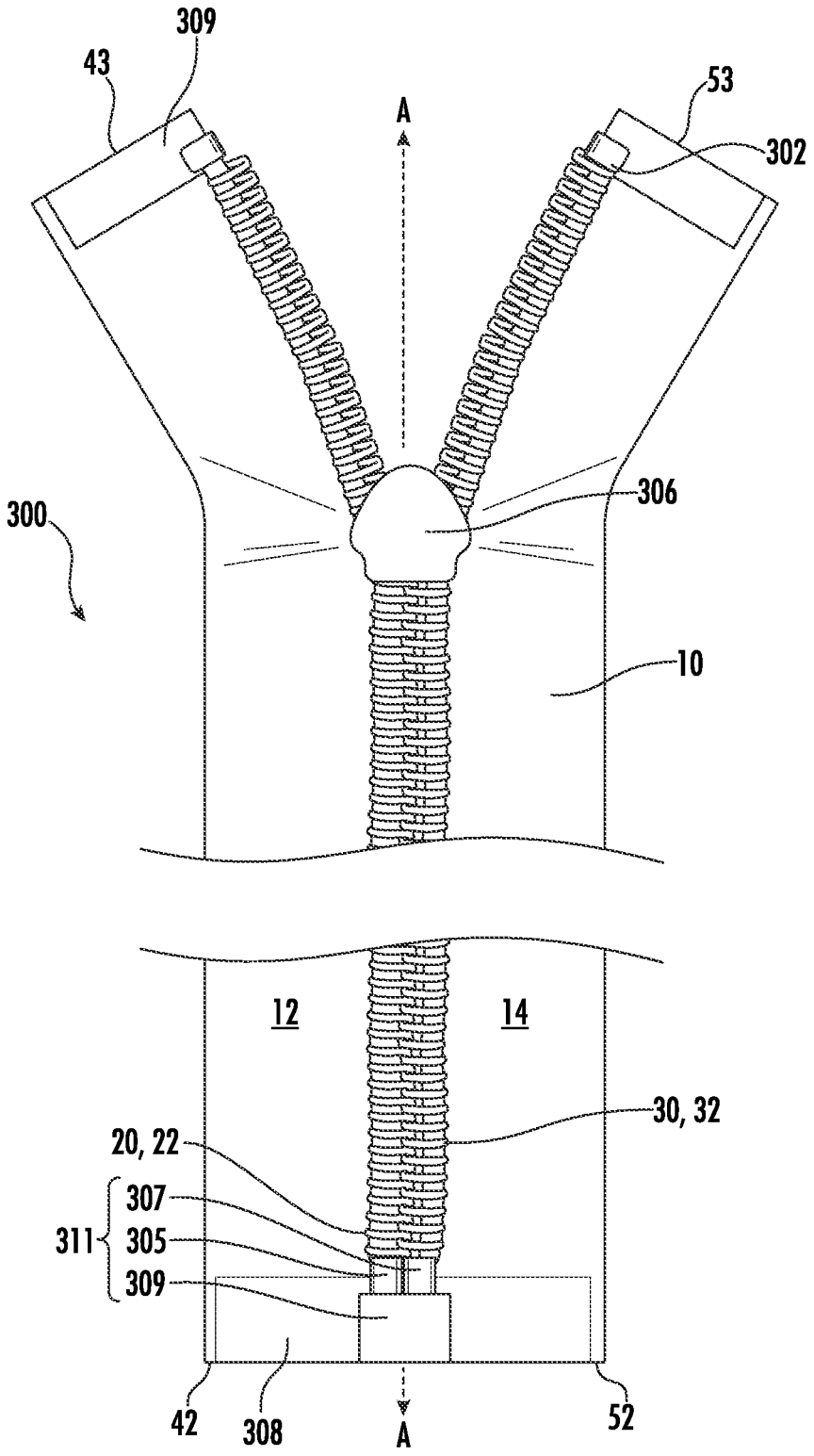
FIG. 4A is a rear view of a slide fastener according to another implementation comprising the fastener chain shown in FIG. 1.
Figure 4B:
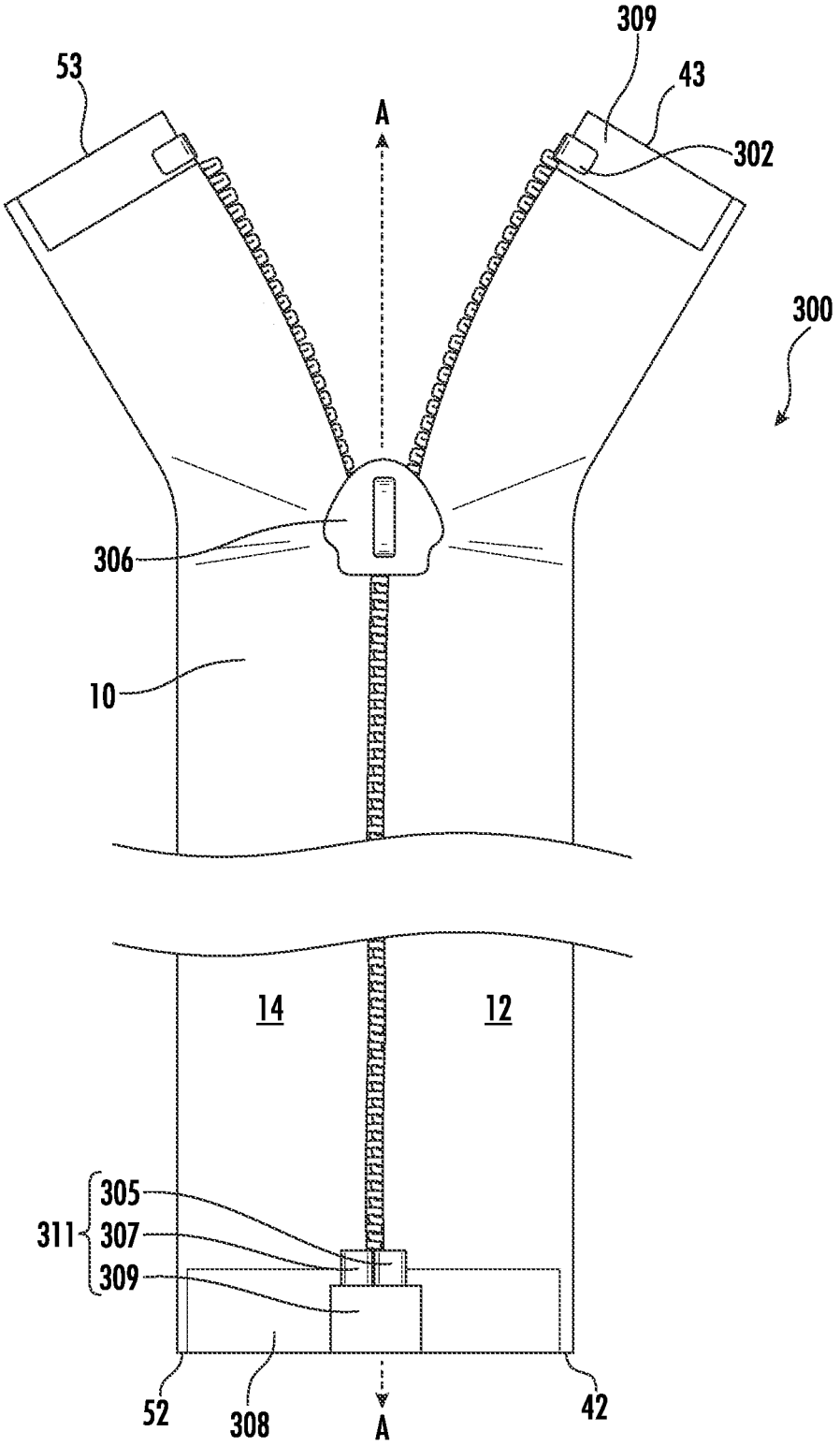
FIG. 4B is a front view of the slide fastener in FIG. 4A.

FIGS. 4A and 4B illustrate another implementation of a slide fastener 300 comprising the fastener chain 10 shown in FIG. 1. Like slide fastener 100, the slide fastener 300 includes a top stop 302 and a slider 306. However, the slide fastener 300 includes open parts 311 instead of the bottom stop 104. The open parts 311 include an insert pin 305, a box pin 307, and retaining box 309. The box pin 307 is coupled to and extends from the retaining box 309, and the insert pin 305 slidably engages the retaining box 309. To engage the insert pin 30 and retaining box 309, the slider 306 is urged into contact with the retaining box 309 such that the box pin 307 is within the slider 306, and the insert pin 305 is slidably inserted through a top opening of the slider 306 and into the retaining box 309. The slider 306 is then moved in the first axial direction over the continuous fastener elements 20, 30 to cause the continuous fastener elements 20, 30 to engage together and is moved in the second axial direction over the continuous fastener elements 20, 30 to cause the continuous fastener elements 20, 30 to disengage with each other. The insert pin 305 is slidably removable from the retaining box 309 when the slider 306 is adjacent the retaining box 309.

In the implementations shown in FIGS. 2A-2B and 4A-4B, the top stops 102, 302, bottom stop 104, open parts 311, and sliders 106, 306 comprise a metal material that is flame and heat-resistant, such as zinc and/or aluminum. For example, in the implementations shown in FIGS. 2A and 2B and 4A and 4B, the sliders 106, 306 and open parts 311 include zinc, and the top stops 102, 302 and bottom stop 104 include aluminum. However, in other implementations, the top stops 102, 302, the bottom stop 104, the open parts 311, and/or sliders 106, 306 may comprise any one or combination of the flame and heat resistant polymer materials described herein. The sliders 106, 306, the top stop 102, the bottom stop 104, and the open parts 311 are well known in the art and are not discussed in further detail here.

The slide fasteners 100, 300 also include a reinforcement film 108, 308 that extends over at least a portion of a bottom portion of the front and rear faces of each fastener tape 12, 14. The bottom portion of each fastener tape 12, 14 extends from the bottom edge 42, 52 to axially below an end of each continuous fastener element 20, 30 that is closest to the bottom edge 42, 52, respectively. A reinforcement film 109, 309 also extends over at least a portion of a top portion of the front and rear faces of each fastener tape 12, 14. The top portion of each fastener tape 12, 14 extends from the top edge 43, 53 to axially above an end of each continuous fastener element 20, 30 that is closest to the top edge 43, 53, respectively. The reinforcement film 108, 308 extends coextensively with at least a portion of the bottom edges 42, 52, respectively, and the reinforcement film 109, 309 extends coextensively with at least a portion of the top edges 43, 53 of the fastener tapes 12, 14, respectively, to prevent the fastener tapes 12, 14 from unraveling. The reinforcement film 308 also provides sufficient stiffness to allow engagement of the open parts 311. The reinforcement film 108, 109, 308, 309 is formed from a flame-resistant and heat-resistant material and includes an adhesive layer for coupling the reinforcement film 108, 109, 308, 309 to the fastener tapes 12, 14. In some implementations, the reinforcement film includes PTFE. However, in other implementations, the film may include any other flame-resistant and heat-resistant film material including, but not limited to, poly-oxydiphenylene-pyromellitimide (KAPTON™) or other polyimides or other fluoropolymers that may be formed into a film.

The coiled monofilaments, such as coiled monofilaments 22, 32 described above, are made by coiling a monofilament comprising the high-temperature polymer at a temperature ranging from 100° C. to 200° C. Existing coiling equipment may be used for coiling with minor adjustments in head size of the coupling surfaces and other dimensions. The coiled monofilaments are then wrapped around cords, such as cords 24, 34, respectively, to form continuous fastener elements, such as continuous fastener elements 20, 30.

Radially outer edges of the continuous fastener elements are then sewn to respective left and right fastener tapes, such as fastener tapes 12, 14. In the implementation shown in FIGS. 2A and 2B, the continuous fastener elements are sewn to the rear faces of the fastener tapes. However, in other implementations, the continuous fastener elements are sewn to the front faces of the fastener tapes. In addition, in some implementations in which a heat set step is not required after coiling, the continuous fastener elements may be fed into the sewing process such that the radially outer edges of the continuous fastener elements are curling down, according to one implementation.

Figure 3:
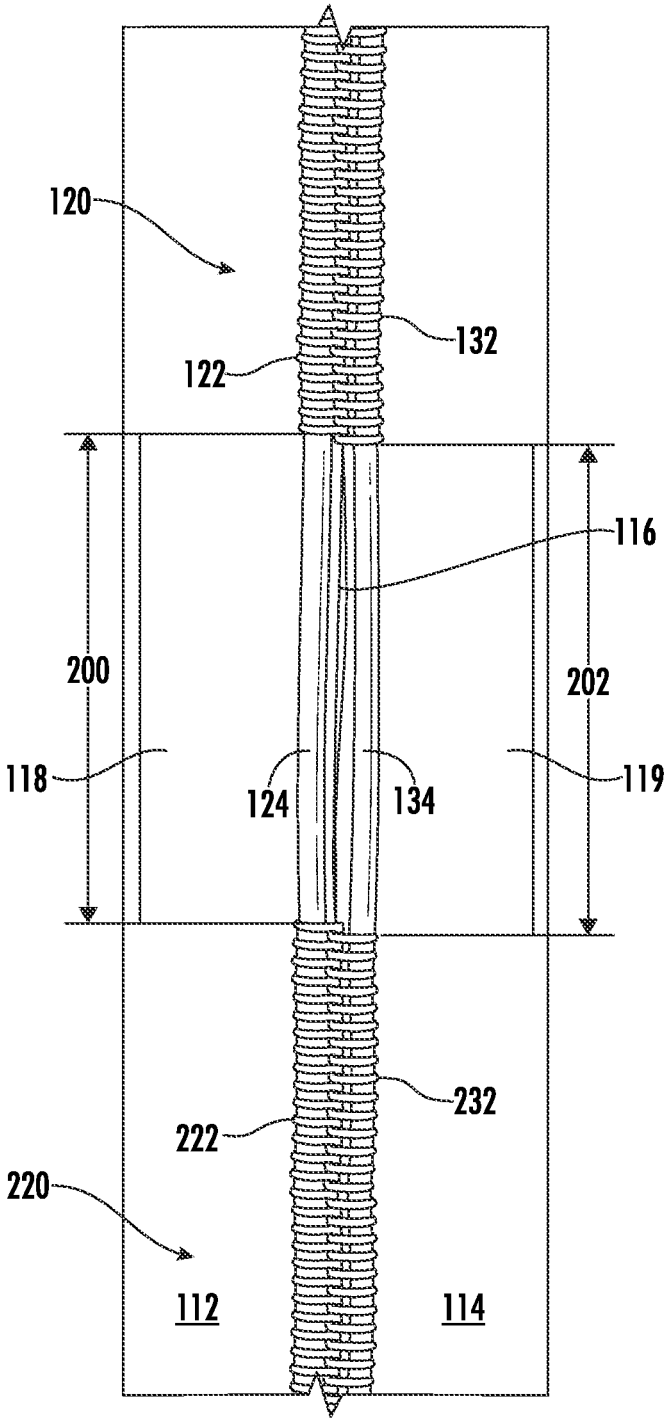
FIG. 3 is a rear view of axial gaps between two pairs of continuous fastener elements, according to one implementation.

To provide space between pairs of coiled monofilaments to allow for cutting a length of fastener chain for use in a slide fastener, axial gaps are defined between the pairs of coiled monofilaments. FIG. 3 illustrates a first coiled monofilament pair 120 and a second coiled monofilament pair 220 before being separated for including in slide fasteners, such as the slide fasteners 100, 300 shown in FIGS. 2A-2B and 4A-4B. The first coiled monofilament pair 120 includes a first left coiled monofilament 122 and a first right coiled monofilament 132, and the second coiled monofilament pair 220 includes a second left coiled monofilament 222 and a second right coiled monofilament 232. A left cord 124 extends through the left coiled monofilaments 122, 222, and a right cord 134 extends through the right coiled monofilament 132, 232. The left coiled monofilaments 122, 222 are sewn to left fastener tape 112, and the right coiled monofilaments 132, 232 are sewn to right fastener tape 114. A lateral gap 116 is defined between adjacent facing tape side edges of the fastener tapes 112, 114, and each pair of coiled monofilaments 120, 220 extends across the lateral gap 116. The portion of the cord 124 that does not extend through coiled monofilaments 122, 222 extends across axial gap 200 defined between axially facing ends of the left coiled monofilaments 122, 222, and the portion of the cord 134 that does not extend through coiled monofilaments 132, 232 extends across axial gap 202 defined between axially facing ends of the right coiled monofilaments 132, 232. To separate the first pair of coiled monofilaments 120 from the second pair of coiled monofilaments 220 for including one of the pairs of coiled monofilaments in a slide fastener, such as the pairs of continuous fastener elements 20, 30 and the slide fastener 100 described above, the fastener tapes 112, 114 and the cords 124, 134 are cut across the axial gaps 200, 202 between the pairs of coiled monofilaments 120, 220.

Prior to cutting across the axial gaps 200, 202 to separate the pairs of coiled monofilaments 120, 220 for including into separate fastener chains, reinforcement films 118, 119, such as reinforcement film 108, 109, 308, 309 described above, are adhered onto front and rear faces of the tapes 112, 114, respectively, adjacent to (e.g., extending between) the ends of each coiled monofilament pair 120, 220. For example, the reinforcement film 118, 119 may be adhered to the fastener tapes 112, 114 within the axial gaps 200, 202.

According to some implementations, if the slide fastener to be manufactured is a closed zipper, meaning the fastener tapes do not fully separate when the fastener elements are disengaged (e.g., because the bottom stop couples them together), the bottom edge of the fastener tapes may have a pinking cut to resist unraveling. A pinking cut is shown in FIGS. 2A and 2B at the bottom edges 42, 52 of the fastener tapes 12, 14. In some implementations, if the slide fastener to be manufactured is a separating, or open, zipper, meaning the fastener tapes fully separate when the fastener elements are disengaged (e.g., the open parts disengage and separate from each other), the bottom edge of the fastener tape has a straight cut. A straight cut is shown in FIGS. 4A and 4B. However, in other implementations, other suitable cuts may be used with open or closed zippers. For example, in some implementations, a pinking cut could be used with an open zipper and a straight cut could be used with a closed zipper.

The products, compositions, and methods of the appended claims are not limited in scope by the specific products, compositions, and methods described herein, which are intended as illustrations of a few aspects of the claims, and any products, compositions, and methods that are functionally equivalent are intended to fall within the scope of the claims. Various modifications of the products, compositions, and methods in addition to those shown and described herein are intended to fall within the scope of the appended claims, even if not specifically recited. Thus, combinations of steps, elements, components, or constituents may be explicitly mentioned herein; however, other combinations of steps, elements, components, and constituents are included, even though not explicitly stated.

The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also described. Other than in the examples, or where otherwise noted, all numbers expressing quantities of ingredients, reaction conditions, and so forth used in the specification and claims are to be understood at the very least, and not as an attempt to limit the application of the doctrine of equivalents to the scope of the claims, to be construed in light of the number of significant digits and ordinary rounding approaches.

As used in the specification and the appended claims, the singular forms "a", "an" and "the" include plural references unless the context clearly dictates otherwise.

Any recited method can be carried out in the order of events recited or in any other order that is logically possible. That is, unless otherwise expressly stated, it is in no way intended that any method or aspect set forth herein be construed as requiring that its steps be performed in a specific order. Accordingly, where a method claim does not specifically state in the claims or description that the steps are to be limited to a specific order, it is no way intended that an order be inferred, in any respect. This holds for any possible non-express basis for interpretation, including matters of logic with respect to arrangement of steps or operation flow, plain meaning derived from grammatical organization or punctuation, or the number or type of aspects described in the specification.

The invention claimed is:

1. A flame-resistant and heat resistant fastener chain, the fastener chain comprising:

a pair of left and right fastener tapes, each fastener tape comprising a facing tape side edge that faces the facing tape side edge of the other fastener tape; and a pair of left and right continuous fastener elements coupled to the respective left and right fastener tapes adjacent the facing tape side edges, each continuous fastener element comprising a coiled monofilament, wherein the coiled monofilaments comprise a high temperature polymer having a melting point from 260 degrees Celsius to 400 degrees Celsius.

2. The fastener chain of claim 1, wherein the high temperature polymer comprises polyethyleneimine (PEI), a liquid crystal polymer (LCP), polyphthalamide (PPA), polyphenylene sulfide (PPS), polyamide 46 (PA46), polytetrafluoroethylene (PTFE), fluorinated ethylene propylene (FEP), a perfluoroalkoxyalkane (PFA), polycylohexylenedimethylene terephthalate (PCT), polyxylylene adipamide (PAMXD6), polybutylene succinate (PBS), or combinations thereof.

3. The fastener chain of claim 1, wherein the high temperature polymer is polyphenylene sulfide (PPS).

4. The fastener chain of claim 1, wherein high temperature polymer has a limiting oxygen index (LOI) of greater than 20%.

5. The fastener chain of claim 1, wherein the high temperature polymer has a color that is different than a natural color for the polymer.

6. The fastener chain of claim 1, wherein each fastener tape comprises flame resistant and heat-resistant fibers.

7. The fastener chain of claim 1, wherein each fastener tape comprises aramid fibers.

8. The fastener chain of claim 1, wherein each fastener tape comprises meta-aramid fibers.

9. The fastener chain of claim 1, wherein each continuous fastener element comprises a cord around which the respective coiled monofilament is wrapped.

10. The fastener chain of claim 9, wherein each cord comprises flame-resistant and heat-resistant fibers.

11. The fastener chain of claim 9, wherein each cord comprises aramid fibers.

12. The fastener chain of claim 9, wherein each cord comprises meta-aramid fibers.

13. The fastener chain of claim 1, further comprising at least one left thread and at least one right thread, wherein the at least one left thread couples the left continuous fastener element to the left fastener tape, and the at least one right thread couples the right continuous fastener to the right fastener tape.

14. The fastener chain of claim 13, wherein each thread comprises flame-resistant and heat-resistant fibers.

15. The fastener chain of claim 13, wherein each thread comprises aramid fibers.

16. The fastener chain of claim 13, wherein each thread comprises para-aramid fibers.

17. The fastener chain of claim 1, wherein the fasteners tapes are woven fastener tapes.

18. A slide fastener comprising the fastener chain according to claim 1.

* * * * *